US012188301B2

(12) United States Patent
Arfele et al.

(10) Patent No.: US 12,188,301 B2
(45) Date of Patent: Jan. 7, 2025

(54) DRILL BIT CUTTER WITH SHAPED PORTION MATCHED TO KERF

(71) Applicant: Halliburton Energy Services, Inc., Houston, TX (US)

(72) Inventors: Robert W. Arfele, Conroe, TX (US); Kelley Plunkett, Conroe, TX (US); Chris Propes, Conroe, TX (US); Bradley David Dunbar, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 91 days.

(21) Appl. No.: 17/990,442

(22) Filed: Nov. 18, 2022

(65) Prior Publication Data

US 2024/0167342 A1 May 23, 2024

(51) Int. Cl.
*E21B 10/567* (2006.01)
*E21B 10/43* (2006.01)

(52) U.S. Cl.
CPC ..... *E21B 10/5673* (2013.01); *E21B 10/43* (2013.01)

(58) Field of Classification Search
CPC ..... E21B 10/5673; E21B 10/43
See application file for complete search history.

(56) References Cited

U.S. PATENT DOCUMENTS

| | | | | |
|---|---|---|---|---|
| 5,582,261 | A * | 12/1996 | Keith | E21B 10/43 175/434 |
| 6,065,554 | A * | 5/2000 | Taylor | E21B 10/5673 175/430 |
| 8,261,858 | B1 | 9/2012 | Atkins et al. | |
| 8,863,860 | B2 | 10/2014 | Chen et al. | |
| 10,267,093 | B2 | 4/2019 | Chen et al. | |
| 10,801,269 | B1 | 10/2020 | Hankins et al. | |
| 10,822,945 | B1 | 11/2020 | Dunbar et al. | |
| 10,920,496 | B2 | 2/2021 | Anderle et al. | |
| 11,053,742 | B1 | 7/2021 | Huynh et al. | |
| 11,060,358 | B2 | 7/2021 | Plunkett et al. | |
| 2014/0110181 | A1* | 4/2014 | Zhang | G06F 30/23 703/2 |
| 2015/0152689 | A1 | 6/2015 | Chen et al. | |
| 2019/0032419 | A1 | 1/2019 | Chen et al. | |
| 2022/0034168 | A1 | 2/2022 | Brackin et al. | |
| 2022/0205356 | A1 | 6/2022 | Brackin et al. | |
| 2022/0403706 | A1* | 12/2022 | Miess | E21B 10/5673 |

* cited by examiner

*Primary Examiner* — D. Andrews
(74) *Attorney, Agent, or Firm* — Michael Jenney; C. Tumey Law Group PLLC

(57) ABSTRACT

A fixed cutter drill bit may include a bit body defining a bit axis and having a plurality of blades extending therefrom. A plurality of cutters are secured to the blades at different circumferential positions relative to the bit axis. Each cutter may define a cutter sweep profile as the bit body rotates about the bit axis. One or more of the cutters may form overlapping cutter sweep profiles to define a kerf therebetween. The cutters include a shaped cutter comprising a cutting face and a shaped portion on the cutting face aligned for engaging and removing the kerf.

19 Claims, 9 Drawing Sheets

DRILL BIT CUTTER WITH SHAPED PORTION MATCHED TO KERF

BACKGROUND

Wells are constructed in subterranean formations in an effort to extract hydrocarbon fluids such as oil and gas. A wellbore may be drilled with a rotary drill bit mounted at the lower end of a drill string. The drill string is assembled at the surface of a wellsite by progressively adding lengths of tubular drilling pipe to reach a desired depth. The drill bit is rotated by rotating the entire drill string from the surface of the well site and/or by rotating the drill bit with a downhole motor incorporated into a bottomhole assembly (BHA) of the drill string. As the drill bit rotates against the formation, cutters on the drill bit disintegrate the formation in proximity to the drill bit. Drilling fluid ("mud") is circulated through the drill string and the annulus between the drill string and the wellbore to lubricate the drill bit and remove cuttings and other debris to surface.

Rotary drill bits are generally categorized as fixed cutter (FC) bits having discrete cutters secured to a bit body at fixed positions (i.e., fixed cutters), roller cone (RC) bits having rolling cutting structures (i.e., roller cones), or hybrid bits comprising both fixed cutters and rolling cutting structures. A fixed cutter is typically secured to the bit body with the cutting table at a particular orientation and position, thereby exposing some portion of the cutting table to the formation. A fixed cutter traditionally has a cylindrical overall shape with a round, flat cutting table. However, as diamond manufacturing continues to improve, more nuanced cutting table shapes continue to be developed that provide various technical advantages.

These drawings illustrate certain aspects of some of the embodiments of the present disclosure and should not be used to limit or define the method.

DETAILED DESCRIPTION

This disclosure relates in part to shaped cutters for drill bits. A shaped cutter according to the disclosure may include one or more shaped portions that are shaped to match a portion of uncut formation referred to as a kerf. The shape of the shaped portion(s) may be determined based on the cutter's location on the bit, such as its location in a cone, nose, or shoulder region, and/or its location on a particular blade. The cutter may be mounted to a bit body at that location, and at a rotational position about its cutter axis, to align the shaped portion to the location of the kerf. The shaped portion is matched to the shape of the shaped portion to the engagement shape between the rock and the cutter depending on location. The shape of the shaped portion may be at least slightly offset inwardly of the shape of the kerf to increase a contact stress with the kerf. The shaped portion is also at a certain height above the flat surface of the cutter, and thus raised with respect to other portions of the cutting table. The shaped portions may be reinforced using a bridge that is at a height between that of a recessed portion of the cutting face and the height of the shaped portion.

In examples, a plurality of shaped portions may be circumferentially positioned about the cutter axis. For example, multiple shaped portions having the same shape and size may be circumferentially spaced for repairability; when one shaped portion is worn, the cutter may be removed and re-attached at another rotational position about its cutter axis to align another of the shaped portions with the kerf. In another example, multiple shaped portions of different sizes may be provided for different depths of cut, or having different shapes corresponding to different available mounting locations on the drill bit.

Figure 1:
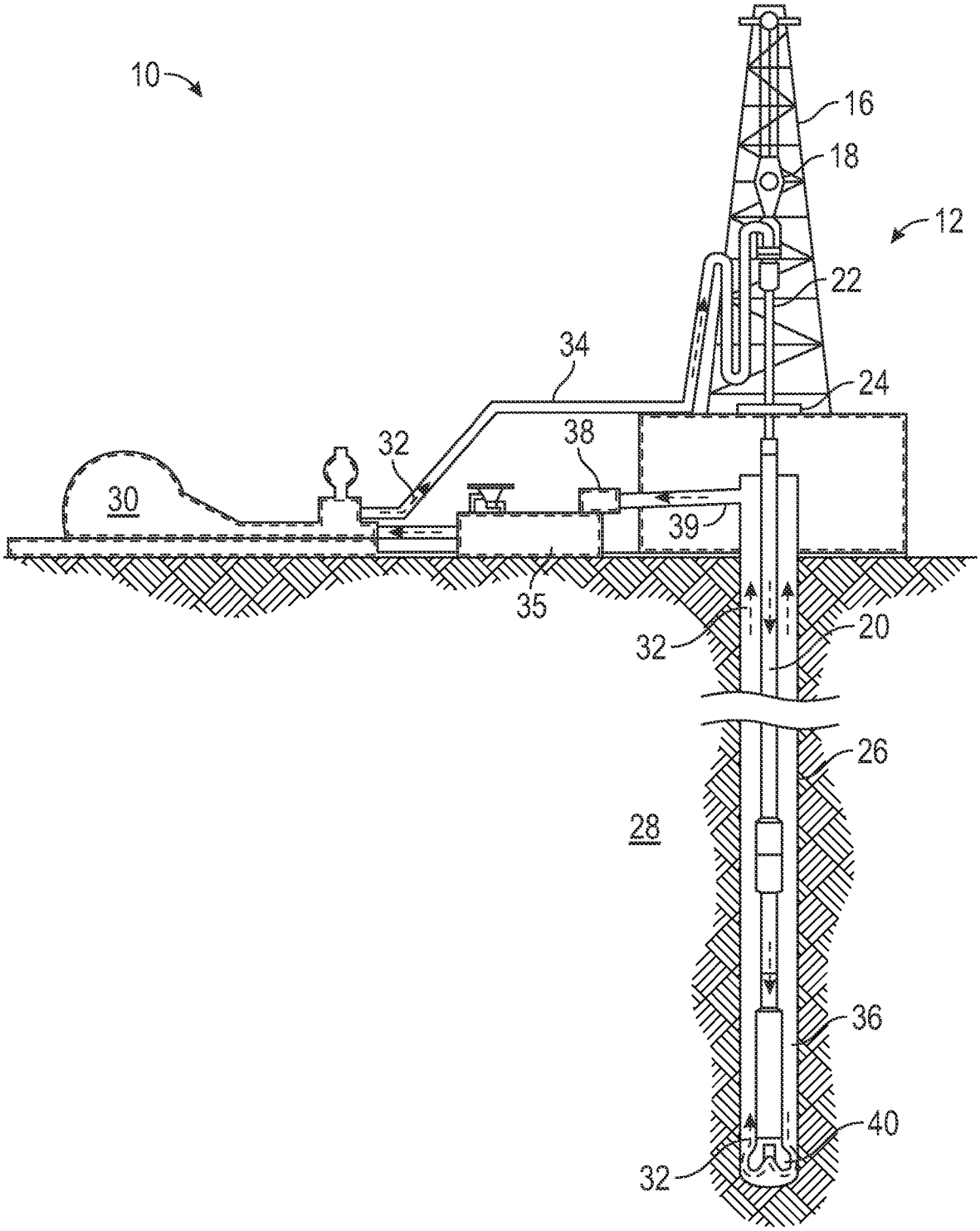
FIG. 1 is an elevation, partially cross-sectional view of a representative well site at which a wellbore may be formed with a drill bit and shaped cutters according to the disclosure.

FIG. 1 is an elevation, partially cross-sectional view of a representative well site 10 at which a wellbore may be formed by drilling and other operations. While FIG. 1 generally depicts land-based drilling, the principles described herein are applicable to subsea drilling operations that employ floating or sea-based platforms and rigs, without departing from the scope of the disclosure. As illustrated, a drilling rig 12 may include a drilling platform 14 that supports a derrick 16 having a traveling block 18 for raising and lowering a drill string 20. The drill string 20 may include, but is not limited to, drill pipe and coiled tubing, as generally known to those skilled in the art. A kelly 22 supports the drill string 20 as it is lowered through a rotary table 24. A rotary drill bit 40 is attached to the distal end of the drill string 20 and may be rotated by via rotation of the drill string 20 from the well surface and/or a downhole motor. The drill bit 40 is a wellbore forming tool that is used to initially form a wellbore 26 in a subterranean formation 28. Other wellbore forming tools may be included on the drill string for use in certain drilling operations, such as one or more hole opener and/or reamer to selectively widen a portion of the wellbore 28, or a coring bit used to obtain and retrieve a sample of the formation for analysis.

The drill bit 40 may be a fixed-cutter or hybrid drill bit having one or more fixed cutters, including one or more shaped cutters as disclosed herein to enhance rock removal. A pump 30 (e.g., a mud pump) circulates drilling fluid (i.e., "mud") 32 through a feed pipe 34 and to the kelly 22, which conveys the drilling fluid 32 downhole through the interior of the drill string 20 and through one or more orifices in the drill bit 40. The drilling fluid 32 is then circulated back to the surface via an annulus 36 defined between the drill string 20 and the walls of the wellbore 26. At the surface, the recirculated or spent drilling fluid 32 exits the annulus 36 and may be conveyed to one or more fluid processing unit(s) 38 via an interconnecting a flow line 39. After passing through the fluid processing unit(s) 38, a cleaned drilling fluid 32 is deposited into a nearby retention pit 35 (i.e., a mud pit). While illustrated as being arranged at the outlet of the wellbore 26 via the annulus 36, those skilled in the art will readily appreciate that the fluid processing unit(s) 38 may be arranged at any other location in the drilling rig 10 to facilitate its proper function, without departing from the scope of the scope of the disclosure.

Figure 2:
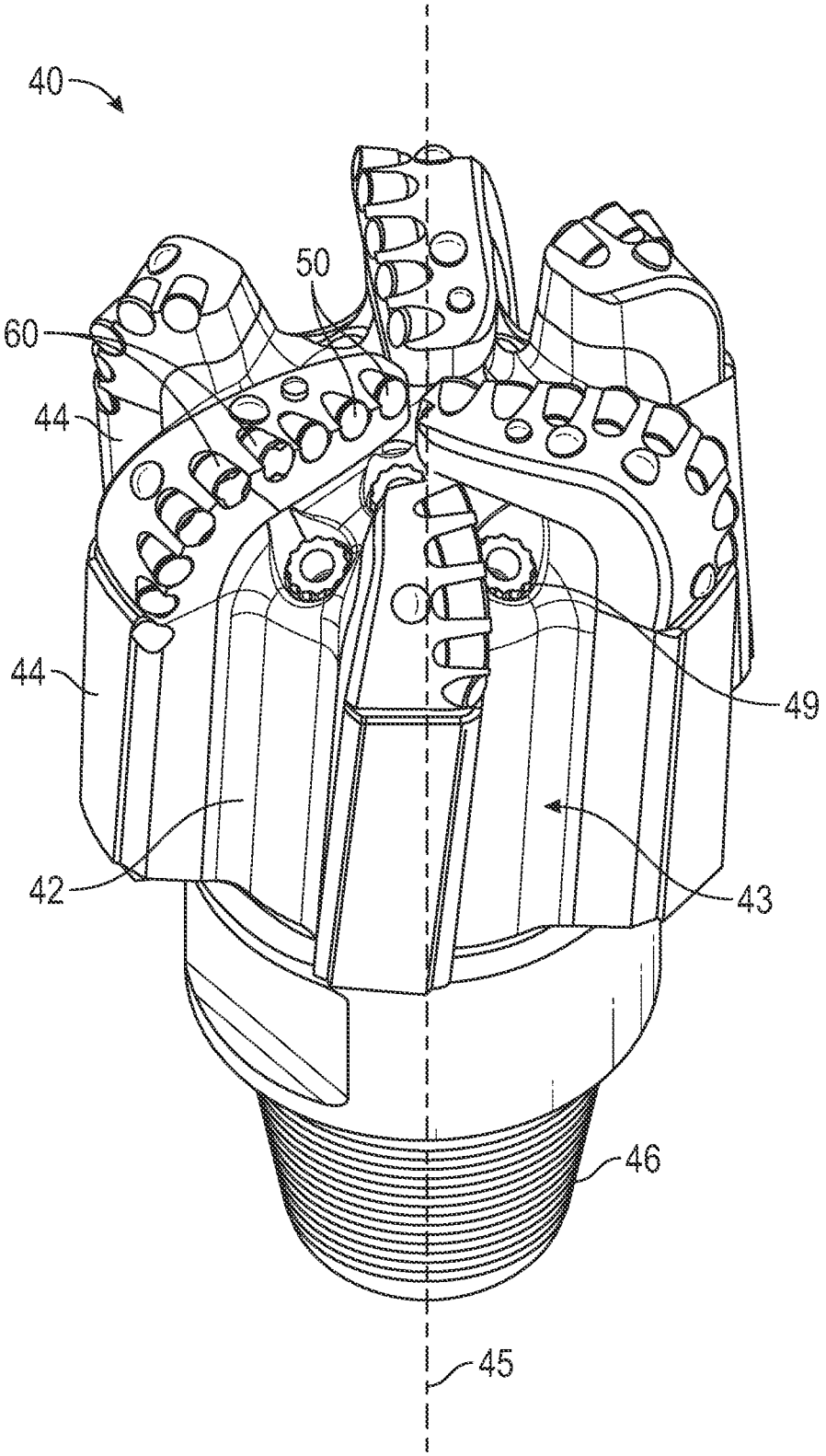
FIG. 2 is a perspective view of an example configuration for the drill bit according to aspects of the present disclosure.

FIG. 2 is a perspective view of an example configuration for the drill bit 40 according to aspects of the present disclosure. The drill bit 40 is oriented in an upward direction for ease of illustrating drill bit features, but would more commonly be directed downwardly vertically or at an angle of deviation to vertical during drilling. The drill bit 40 includes a rigid bit body 42. The bit body 42 may be described as a fixed cutter (FC) type bit body in that it supports having cutters 50, 60 secured to the bit body 42 at fixed locations around the bit body 42. The bit body 42 defines a bit axis 45 about which the drill bit 40 may rotate while drilling. The bit axis 45 may pass centrally through the bit body 42 and/or coincide at least approximately with a center of mass of the drill bit 40. The bit axis 45 is typically aligned with an axis of a drill string or other conveyance to which the drill bit 40 is coupled. Drill bits generally may be connected in any of a variety of ways to a drill string, coiled tubing, or other conveyance to allow for rotation about the bit axis 45. In this example, the drill bit 40 may include a metal shank 46 with a threaded connection for securing to a drill string. This connection may generally align the bit axis 45 with an axis of the drill string or other desired axis of rotation.

The bit body 42 includes a plurality of blades 44 formed on the exterior of the bit body 42. The blades 44 are radially extending and circumferentially spaced from each other with respect to the bit axis 45, defining fluid flow paths or junk slots 43 therebetween. The blades 44 also support the various fixed cutters 50, 60. While drilling, an axial force such as weight on bit (WOB) may be applied in a direction of the bit axis 45, such that the cutters 50, 60 engage the formation being drilled. Simultaneously, the drill bit 40 is rotated about the bit axis 45 to engage the earthen formation to cut material ("rock") from the formation. Drilling fluid circulated downhole may lubricate the drill bit 40 and remove the cuttings and other fluid contaminants to the surface, such as generally described above in relation to FIG. 1. Nozzles 49 may be direct the flow of drilling fluid through the drill bit and to the junk slots 43 to help remove cuttings/chips of formation material.

Figure 3:
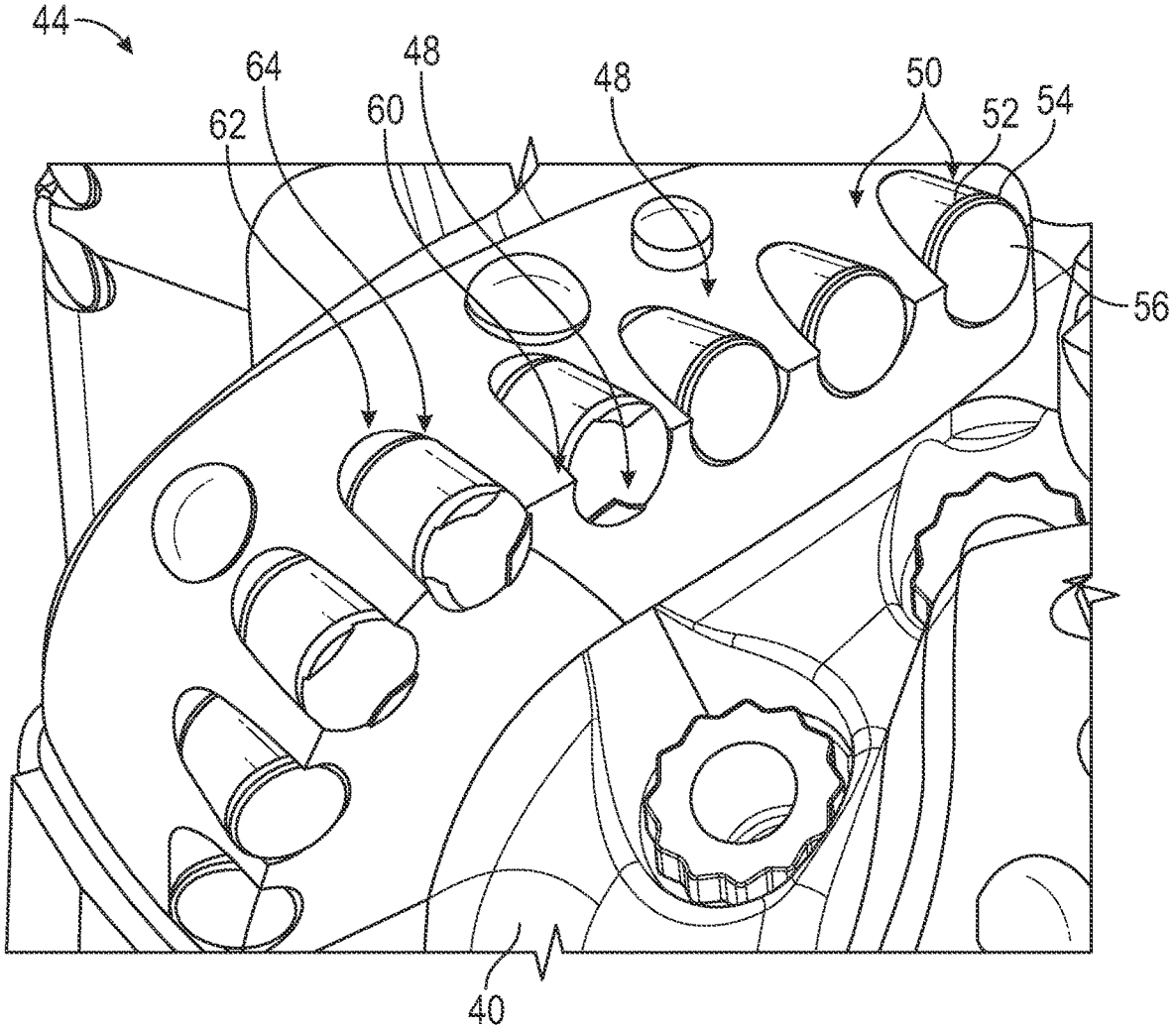
FIG. 3 is an enlarged, perspective view of one of the blades of FIG. 1 showing a closer view of some cutters on that blade.

FIG. 3 is an enlarged, perspective view of one of the blades 44 of FIG. 1 showing a closer view of some cutters 50, 60 on that blade 44. A plurality of cutter pockets 48 formed on the blades 44 receive the cutters 50, 60 at the various fixed locations around the bit body 42. The cutters include traditional round cutters 50, in addition to the shaped cutters 60 according to this disclosure. A drill bit according to some examples may include different numbers and/or ratios of round cutters 50 and shaped cutters 60 than what is shown. Other example bits could exclusively have shaped cutters according to the disclosure, with no round cutters. The cutters includes substrates received by a respective cutter pocket 48 and secured within the cutter pocket 48 such as by brazing. Each round cutter 50 includes a substrate 52 with a round, generally flat cutting table 54 secured to the substrate 52. Each shaped cutter 60 includes a shaped cutting table 64 secured to a substrate 62. The substrates 52, 62 may be formed of a hard, rigid material such as tungsten carbide (WC).

The cutting tables 54, 64 are typically formed by subjecting a diamond-based material, such as polycrystalline diamond (PCD) to a high-temperature, high-pressure (HTHP) press cycle, wherein grains of diamond-based material are sintered to form the diamond tables 54, 64. Typically, the diamond tables are simultaneously bonded to the respective substrates 52, 62 in the same press cycle, although diamond tables can alternatively be formed separately and subsequently bonded to their substrates. The cutting tables 54 of the round cutters 50 have a generally flat, smooth cutting face 56 that may be as-formed in the press cycle. The shaped cutters 60 may also have round/cylindrical substrates 62 but their cutting tables 64 are shaped (i.e., shaped cutting tables) to define cutting faces having non-circular features shaped to match the expected shape of a kerf, or portion of uncut formation left by other cutters as described below. The shaped cutting tables 64 may be initially formed with a round, flat shape and subsequently shaped using laser ablation, electrical discharge machining (EDM), or other suitable machining or forming technique, or a combination thereof.

Figure 4:
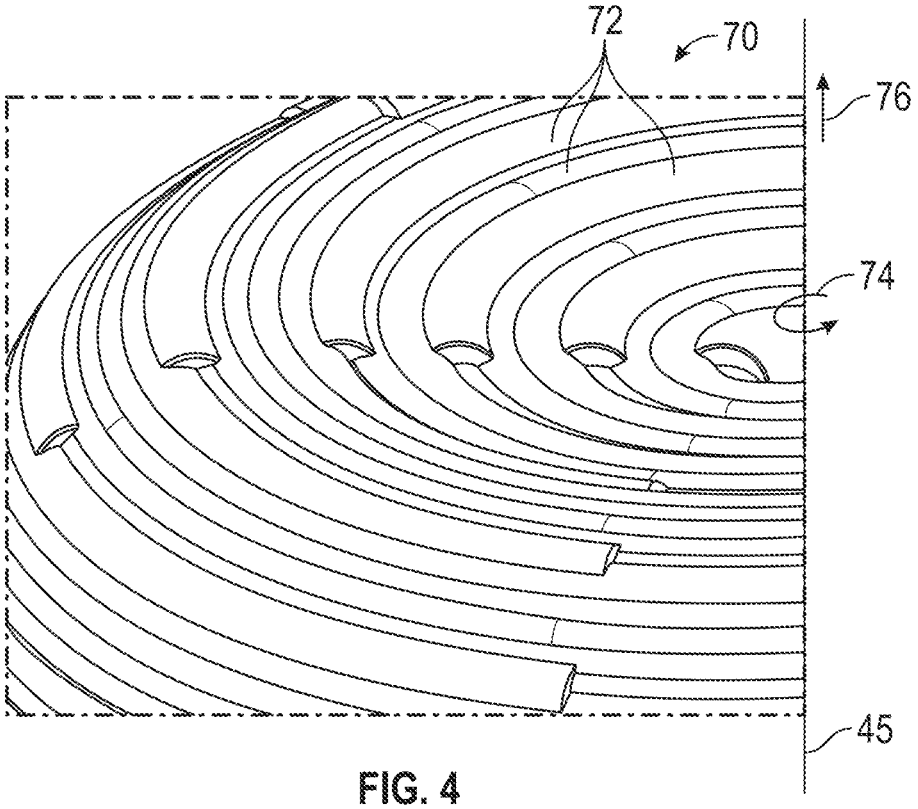
FIG. 4 is a perspective view of an example bit sweep profile defined by a revolution of fixed cutters about the bit axis.

FIG. 4 is a perspective view of an example bit sweep profile 70 defined by a revolution of fixed cutters about the bit axis 45. The bit sweep profile 72, like the drill bit of FIG. 2, is oriented in an upward direction for ease of illustration. The bit sweep profile comprises individual cutter sweep profiles 72 of respective cutters. The cutter sweep profiles 72 are like three-dimensional pathways swept in space by revolution of the cutters about the bit axis 45 as the drill bit rotates, typically in combination with advancing the bit in an axial direction with respect to the bit axis 45. The cutter sweep profiles 72 represent an aggregate cutting surface collectively defined by the respective cutters that would engage the formation being drilled. A negative of the bit sweep profile 70 is referred to as the bottomhole pattern, which is the shape of the formation at any instant in time while being drilled. Adjacent cutter sweep profiles 72 are overlapping by design to ensure full removal of formation material. However, at any given instant, portions of formation material may remain, referred to as kerfs, which is a feature of the bottomhole pattern corresponding to space between the overlapping cutter sweep profiles 72. For a steady state condition (e.g., constant rotational rate and axial rate of movement), the bit sweep profile 70, overlapping cutter sweep profiles 72, and corresponding bottomhole pattern are presumed to be constant for purpose of design and analysis.

The bit sweep profile 70 and cutter sweep profiles 72 are determinable for a particular bit design, which lends itself to modeling using computers. For example, particularly with the aid of a computer system tailored for drill bit design, the shape of the cutter sweep profiles 72 and the shapes of the kerfs between overlapping cutter sweep profiles 72 may be determined in advance for a particular drill bit design. These may be determined in combination with bit dynamic parameters such as a bit rotation rate 74, which may be quantified as revolutions per minute (RPMs) for example, and an axial drilling rate 76. The axial drilling rate 76 may also be determined with the aid of a computer, such as using finite element analysis software in combination with the mechanical properties of formation material being drilled, the design of the drill bit, the weight on bit (WOB), and other bit dynamic parameters.

Figure 5:
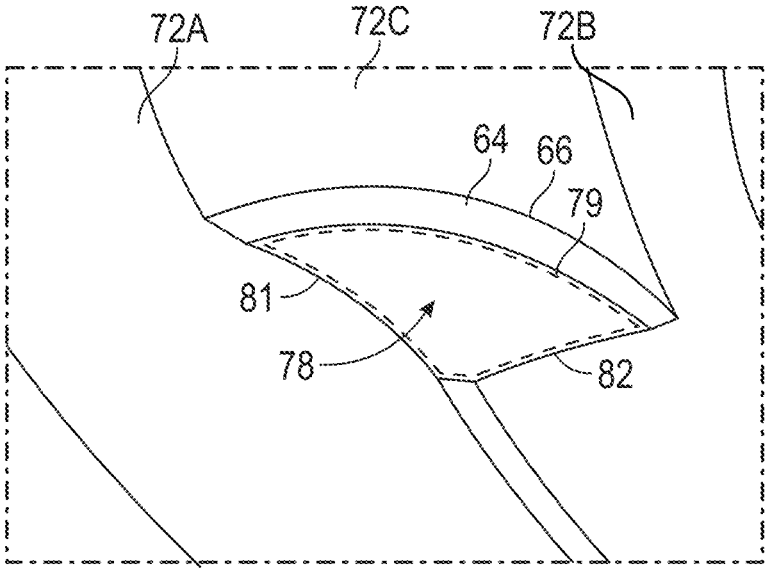
FIG. 5 is an enlarged view of the bit sweep profile of FIG. 4 spanning a small number of overlapping cutter sweep profiles.

FIG. 5 is an enlarged view of the bit sweep profile 70 of FIG. 4 spanning a small number of overlapping cutter sweep profiles specifically identified at 72A, 72B, and 72C. A kerf 78 is defined between two of the cutter sweep profiles 72A, 72B, bounded in part by two overlapping arcs 81, 82 formed by the two overlapping cutter sweep profiles 72A, 72B. A shaped portion 66 of the cutting table 64 of one of the shaped cutters is specifically aligned for engaging the kerf 78 for engaging and removing the kerf 78. The shaped portion 66 may be at the highest point on the cutting table in axial direction of a cutter axis; hence, the shaped portion 66 may be a raised portion with respect to other features of the cutting table. Preferably, the shaped portion 66 is not only aligned with the kerf 78 but also has a shape matching a shape of the kerf, i.e., the kerf 78 and the shaped portion 66 may have substantially the same shape, along a periphery of the kerf 78. In some examples, the shaped portion 66 may be the same size as the kerf 78. In other examples, the shape of the shaped portion may be intentionally made slightly smaller than the kerf 78 such that the shaped portion 66 is at least slightly inwardly offset from the shape of the kerf 78 along all (or most of) the periphery, as indicated by offset line 79. Sizing the shaped portion 66 to be slightly smaller than the kerf 78 will function to increase a contact stress where the shaped portion 66 engages the kerf 78, resulting in more efficient cutting.

Figure 6:
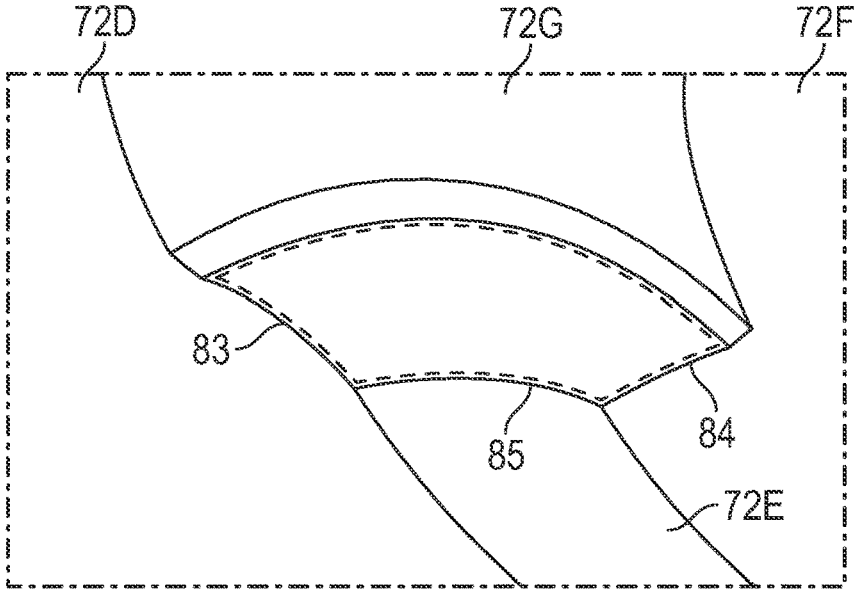
FIG. 6 is an enlarged view of the bit sweep profile of FIG. 4 spanning a different set of overlapping cutter sweep profiles.

FIG. 6 is an enlarged view of the bit sweep profile 70 of FIG. 4 spanning a different set of overlapping cutter sweep profiles specifically identified at 72D, 72E, and 72F. This results in a somewhat differently shaped kerf bounded by three overlapping arcs 83, 84, 85. Thus, FIGS. 5 and 6 represent just two examples of shapes of kerfs, for which corresponding shaped portions may be formed on shaped cutters to engage those kerfs. The kerfs may be predicted in advance, such as using computer simulations, so that each shaped cutter is positioned on the drill bit with a position and shape that matches the expected position and shape of the kerf at that cutter position.

Figure 7:
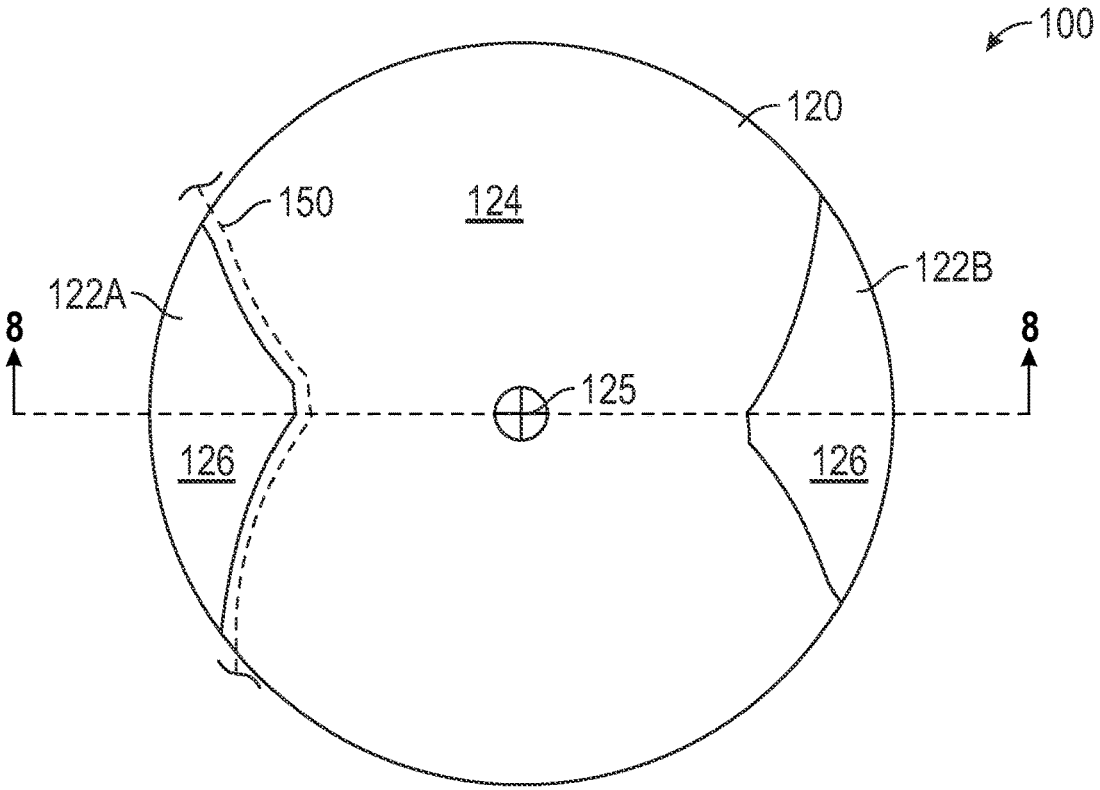
FIG. 7 is a top view of a shaped cutter having an example of a shaped cutting table comprising two shaped portions whose shapes are matched to the same kerf shape.

FIG. 7 is a top view of a shaped cutter 100 having an example of a shaped cutting table 120 comprising two shaped portions 122A, 122B. The shaped portions 122A, 122B may be at the highest point on the cutting table in axial direction of a cutter axis; hence, the shaped portion 66 may be a raised portion with respect to other features of the cutting table. The shaped portions 122A, 122B project axially (out of the plane of FIG. 7) at a height HR with respect to an otherwise generally planar recessed portion 124 of the cutting table 120. The two shaped portions 122A, 122B are circumferentially evenly spaced, i.e., at about 180 degrees apart about a cutter axis 125, thus providing redundancy. Optionally, the shaped portions 122A, 122B are the same shape and size. Therefore, the shaped cutter 100 may be positioned so that either shaped portion 122A, 122B may be positioned about the cutter axis 125 to align with a kerf schematically indicated at 150. When one of the shaped portions, e.g., 122A, becomes worn or damaged, the cutter may be removed and re-attached to the drill bit with the cutting table 120 rotated about the cutter axis 125 to align the other shaped portion, e.g., 122B with the kerf 150. The shaped portions 122A, 122B are the same size and shape in this example, and both are slightly offset inwardly with respect to the shape of the kerf 150 as indicated by the gap between the shaped portion 122A and the dashed line of the kerf 150.

Figure 8:
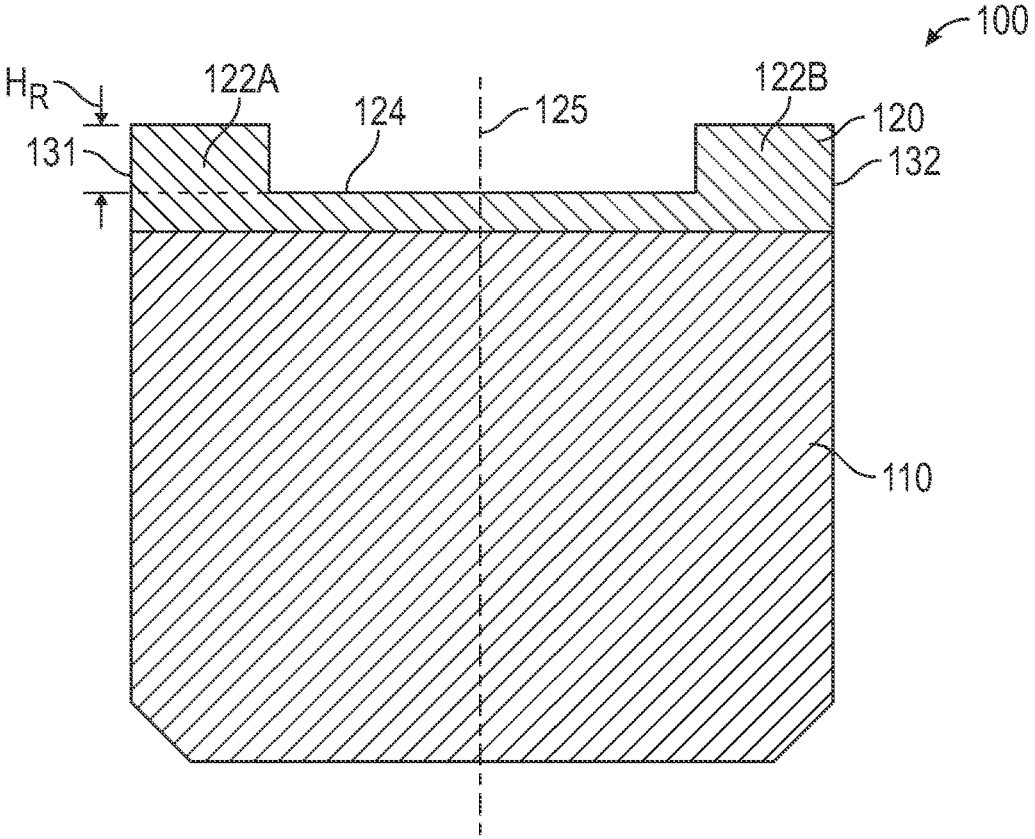
FIG. 8 is a sectional view of the shaped cutter taken along sectional plane 8-8 of FIG. 7.

FIG. 8 is a sectional view of the shaped cutter 100 taken along sectional plane 8-8 of FIG. 7. The cutter axis 125 in this example is centrally defined through the substrate 110 and cutting table 120 secured thereto. The profile of the cutting table 120 in this plane is visible from a first location 131 on a periphery of the cutting table 120 to a second, opposing location 132 on the periphery. In a direction from the first location 132 to the second location 132, the profile of the cutting table 120 steps down from the first shaped portion 122A to the otherwise generally planar recessed portion 124 and back up to the second shaped portion 122B. The step down and step up are depicted as being at right angles in this example, but could be chamfered or filleted at that angle.

Figure 9:
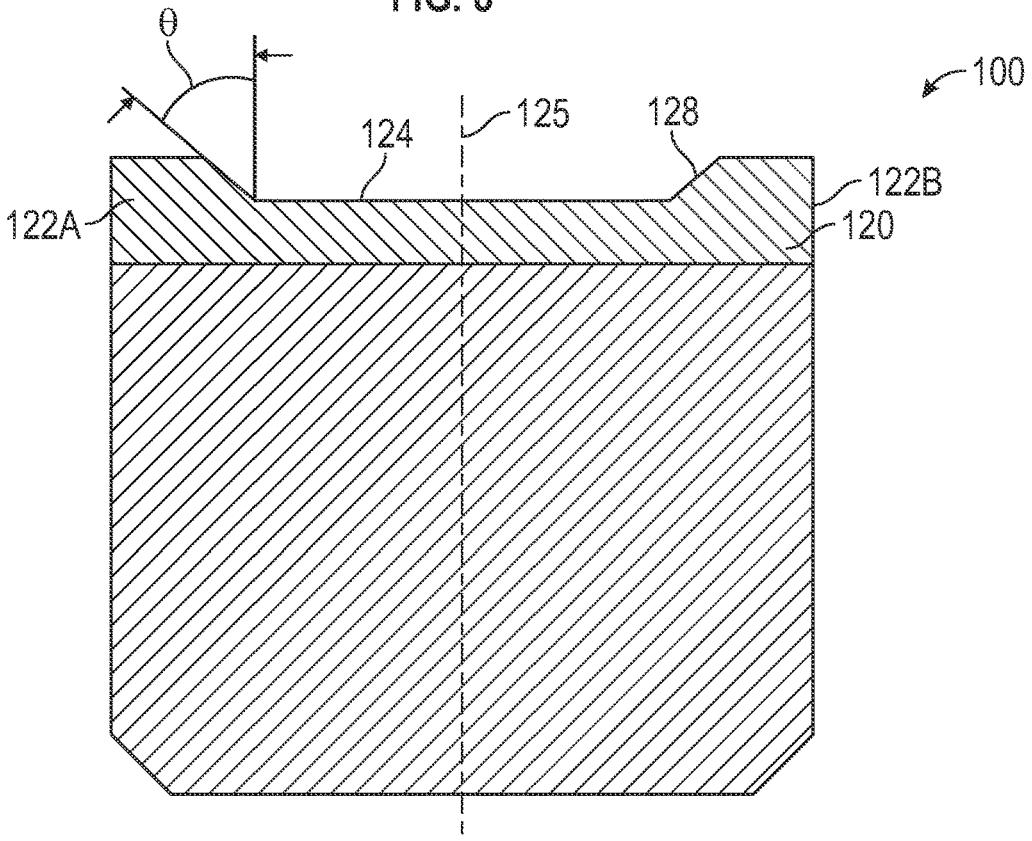
FIG. 9 is a sectional view of the shaped cutter according to an alternate configuration of the cutting table with tapered surfaces stepping down from shaped portions to the recessed portion.

FIG. 9 is a sectional view of the shaped cutter 100 according to an alternate configuration of the cutting table 120 wherein the step down from shaped portions 122A, 122B to the recessed portion 124 define tapered surfaces 128 with a taper angle θ. The taper angle θ may be in a range of between 45 and 75 degrees with respect to the cutter axis 125 in some examples, and specifically 65 degrees in one specific example.

Figure 10:
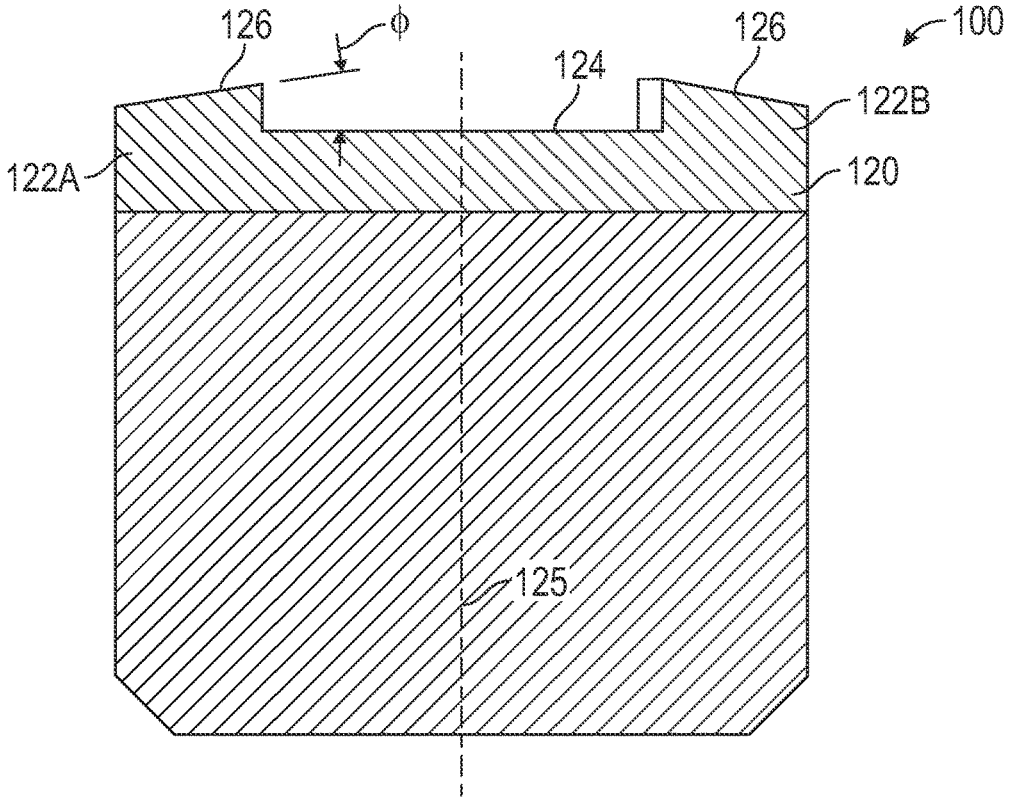
FIG. 10 is a sectional view of the shaped cutter according to another example configuration wherein the cutting face is not perpendicular to the cutter axis.

FIG. 10 is a sectional view of the shaped cutter 100 according to another example configuration of the cutting table 120, wherein the cutting face 126 is not perpendicular to the cutter axis 125. Rather, the cutting face 126 defined by the shaped portions 122A, 122B is angled upwardly from the periphery toward the center of the cutter 100 at a slope angle Φ, which is at an acute angle with respect to the cutter axis 125. The slope angle Φ may be positive or negative, and is shown as a positive angle in FIG. 10 by way of example. The magnitude of the slope angle Φ may be in a range of between 1 and 45 degrees in some examples, i.e., ±1° to ±45°. A preferred range has a magnitude of between 2 and 30 degrees, i.e., ±2° to ±30°. A practical range of the slope angle based, e.g., on manufacturing considerations and typical use conditions may be in a narrower range of magnitude of between 5 and 20 degrees, i.e., ±5° to ±20°.

Figure 11:
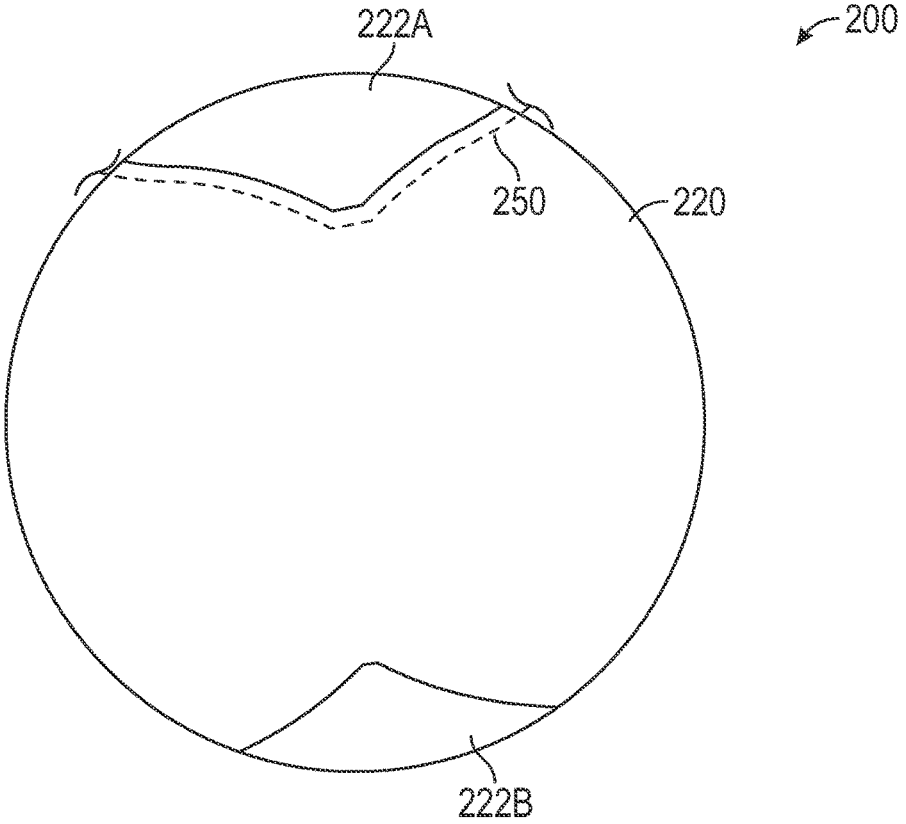
FIG. 11 is a top view of a shaped cutter having two shaped portions of the same shape but different sizes, corresponding to different depths of cut.

FIG. 11 is a top view of a shaped cutter 200 having another example of a shaped cutting table 220 comprising two shaped portions 222A, 222B wherein the shaped portions 222A, 222B are the same shape but different sizes, corresponding to different depths of cut. For more aggressive drilling applications involving a greater depth of cut, the cutter 200 may be positioned so that the larger shaped portion 222A will be aligned with the expected kerf schematically outlined at 250. A more aggressive drilling application may entail, for example, a greater weight on bit (WOB) for a given formation type, resulting in a taller or otherwise larger kerf 250. For a less aggressive drilling application, e.g., a lesser WOB, the cutter 200 may be positioned so the smaller shaped portion 222B is instead aligned with the expected kerf 250. Other geometrical features of other embodiments may also be included where applicable, such as the step down from the shaped portions 222A, 222B to the recessed portion 224 of the cutting table 220, the optional radius, chamfer, and tapers and corresponding angle and height ranges.

Figure 12:
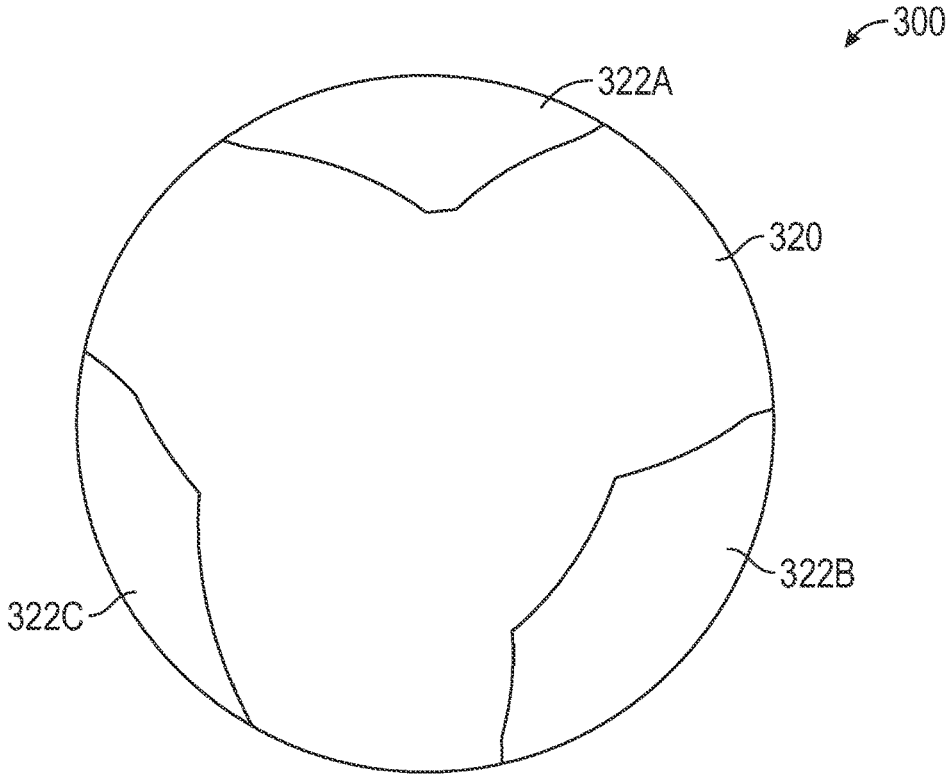
FIG. 12 is a top view of another shaped cutter comprising three shaped portions of different shapes corresponding to different cutter location.

FIG. 12 is a top view of another shaped cutter 300 having yet another example of a shaped cutting table 320 comprising three shaped portions 322A, 322B, 322C all of different shapes. The shape of each shaped portion 322A, 322B, 322C may correspond to a different cutter location where such a cutter could be mounted on a drill bit, and the different shapes of the respective kerfs expected at that locations. For example, the locations may be different zones of the drill bit, e.g., a nose region, cone region, gauge region, etc., and either on different blades or different locations on the same blade. This version of the cutter 300 may reduce manufacturing costs and/or simplify part count by allowing the same cutter design to be used at different cutter locations, just by selecting the shaped portion whose shape best matches the expected shape of the kerf at the cutter location. The shape of the shaped portions 322A, 322B, 322C may also be generalized so that it approximately conforms to a general kerf shape, where similar kerf shapes are expected to occur. For example, one of the shaped portions 322B includes two overlapping arcs that might correspond to one or more cutter locations on a bit where three cutter sweep profiles intersect. Another shaped portion 322A has two overlapping arcs that might correspond to other locations on a bit where two cutter sweep profiles intersect.

The foregoing examples include a cutting table with a plurality (two or more) shaped portions. Some examples (e.g., FIG. 11) provide two or more identical shaped portions so that when one shaped portion wears, the cutter may be removed and repositioned on the bit body to expose another of the shaped portions. Other examples (e.g., FIG. 12) provide a plurality of different shaped portions for using the same cutter at any of a plurality of cutter locations. However, it should be recognized that a cutter may have as few as one shaped portion or greater than three shaped portions circumferentially spaced about a cutter axis.

In some of the foregoing examples, the shaped portions define a cutting face shaped to match a kerf, and that step all the way down to a recessed portion radially inward of the shaped portions. Other examples, described below, may include a reinforcing bridge extending across the cutting face to each of the shaped portions. The reinforcing bridge may have a height of between that of the recessed portion of the planar cutter face and the height of the shaped portion(s).

Figure 13:
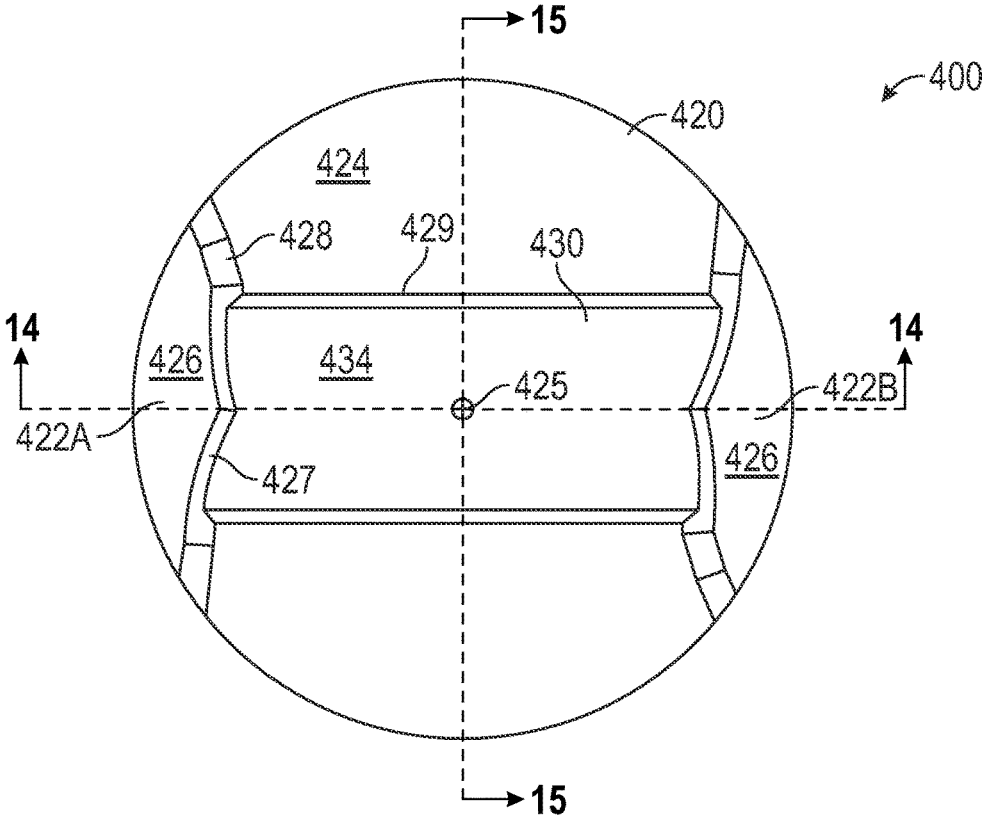
FIG. 13 is a top view of a shaped cutter having two identical shaped portions interconnected by a reinforcing bridge.

FIG. 13 is a top view of a shaped cutter 400 having two identical shaped portions 422A, 422B interconnected by a reinforcing bridge. The shaped portions 422A, 422B are circumferentially spaced at about 180 degrees about the cutting table 420. The shaped portions 422A, 422B define a cutting face 426, which steps down to a generally planar top face 434 of the bridge 430, and down to the recessed portion 424. Various tapered surfaces are provided including a tapered surface 427 stepping down from cutting face 426 to planar top face 434 of the bridge 430, a tapered surface 428 stepping down from the cutting face 426 to the recessed portion 424, and a tapered surface 429 stepping down from the planar top face 434 of the bridge 430 to the recessed portion 424 of the cutting table 220.

Figure 14:
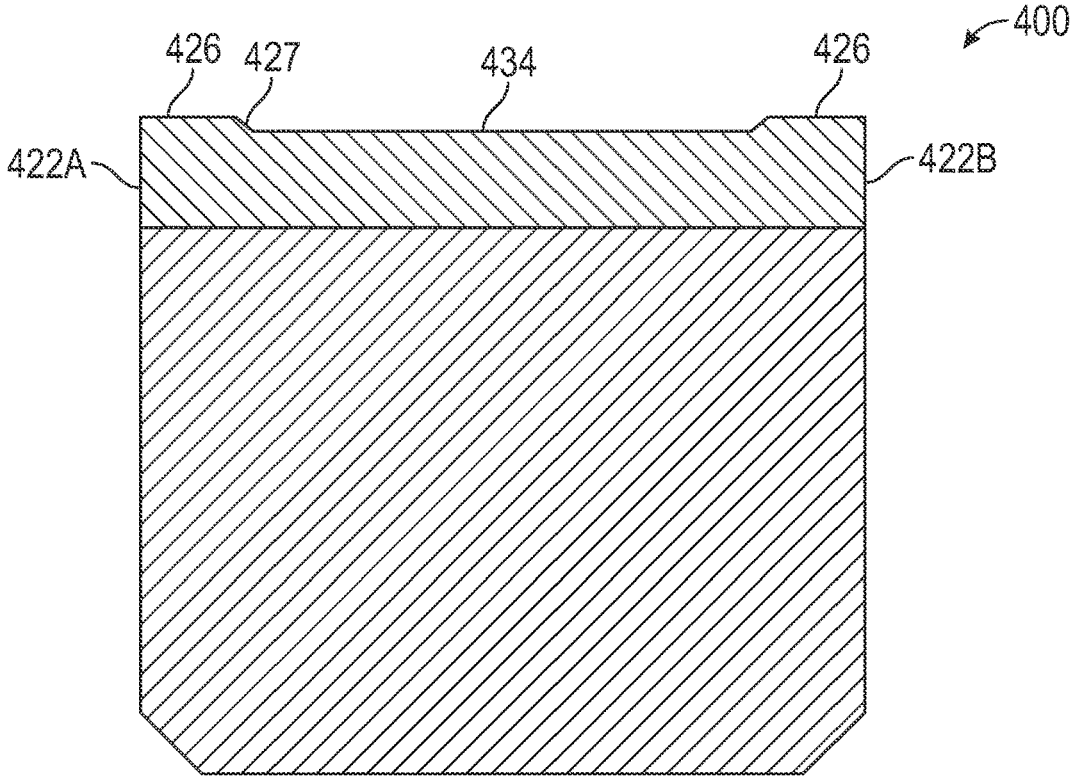
FIG. 14 is a sectional view of the cutter directed at plane 14-14 of FIG. 13.

FIG. 14 is a sectional view of the cutter 400 directed at plane 14-14 of FIG. 13 showing the tapered surface 427 stepping down from cutting face 426 of the first shaped portion 422A, to planar top face 434 of the bridge 430, and back up to the cutting face 426 on the second shaped portion 422B.

Figure 15:
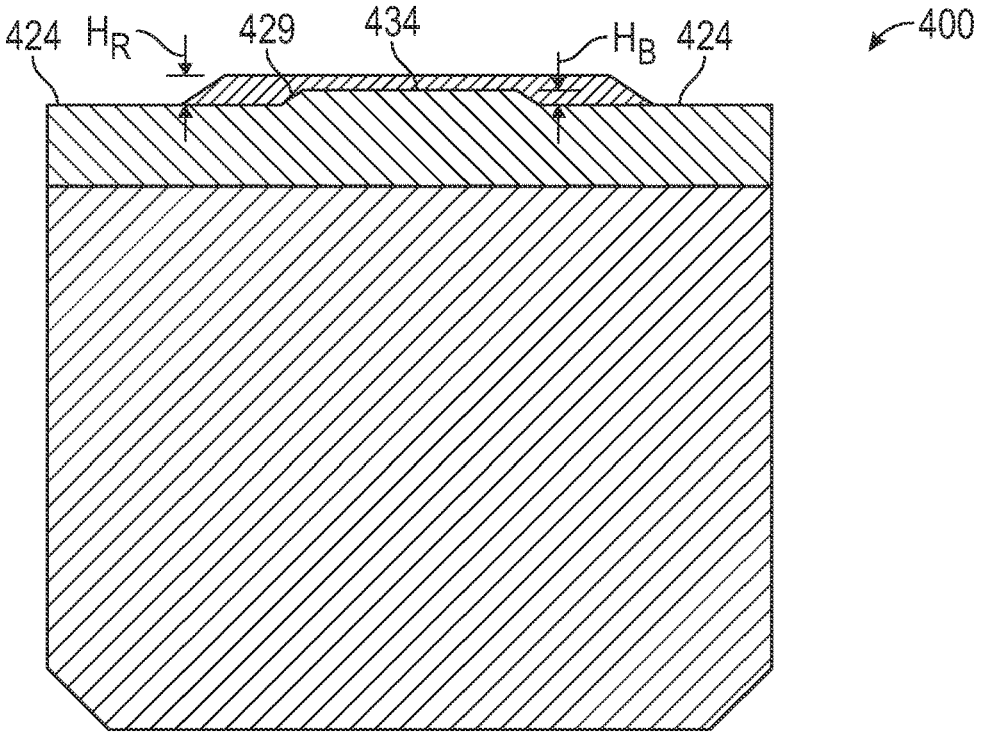
FIG. 15 is a sectional view of the cutter directed at plane 15-15 of FIG. 13.

FIG. 15 is a sectional view of the cutter 400 directed at plane 15-15 of FIG. 13, showing the tapered surface 429 stepping up from the recessed portion 424 on one side of the bridge 430 to the planar top face 434 of the bridge 430 and back down to the recessed portion 424 on the other side of the bridge 430. The reinforcing bridge has a bridge height HB with respect to the recessed portion of the cutting table of less than a height HR of the shaped portions with respect to the recessed portion of the cutting face. The bridge height HB in some examples may be at least half of the height HR of each shaped portion.

Though specific example shapes of shaped cutters have been disclosed herein for purposes of discussion, it should be recognized that other shapes may be devised according to the present teachings, including any suitable combinations of any of the features of the various examples, and that all such other shapes should be considered to be within the scope of this disclosure.

This disclosure also encompasses methods of forming a drill bit and methods of using a drill bit, such as by drilling. For instance, a method of forming a drill bit may comprise securing a plurality of cutters at different positions on a bit body defining a bit axis and identifying overlapping cutter sweep profiles to be defined by rotating the bit body about the bit axis. A kerf may also be identified, as defined between the overlapping cutter sweep profiles. A shaped cutter may then be formed based on this analysis, with a shaped portion on the cutting face having a shape conforming with a shape of the kerf. The shaped cutter may be secured to the drill bit with the shaped portion of the shaped cutter aligned with the kerf. This may be performed for as few as one shaped cutter, for multiple cutters, or even for all cutters on the drill bit. One or more of these steps may be performed using bit design and/or modeling software.

The method may include forming the shaped cutter with a plurality of shaped portions of the same size and shape, circumferentially spaced about a cutter axis. The method may include identifying the overlapping cutter sweep profiles and the corresponding kerf and the shape of the raised portion based on target values of one or more bit dynamic parameters including one or both of a bit rotation rate and an axial drilling rate. For example, more aggressive parameters may result in a larger depth of cut and large kerf size. In some cases, the shaped cutter may be formed with a plurality of shaped portions circumferentially spaced about a cutter axis, each sized corresponding to a different depth of cut. Still other examples may entail forming the shaped cutter with a plurality of shaped portions circumferentially spaced about a cutter axis, each shaped according to a different cutter location on the bit body.

A related method may include drilling a wellbore using such a drill bit with shaped cutters taught in the disclosure. For example, a drilling method may include rotating a drill bit about a bit axis with a plurality of cutters engaging the formation, each cutter defining a cutter sweep profile as it travels about the bit axis. A kerf may be formed in the formation between cutters having overlapping cutter sweep profiles and removed with a shaped cutter having a shaped portion aligned with the kerf and a shape conforming to a shape of the kerf.

Accordingly, the present disclosure may provide a shaped cutter for use on a drill bit, a drill bit with one or more such cutters, methods of designing such shaped cutters and drill bits, and methods of drilling using such shaped cutters and drill bits. The cutters, bits, methods, and any other subject matter falling within the scope may include any of the various features disclosed herein, including one or more of the following examples.

Example 1. A fixed cutter drill bit, comprising: a bit body defining a bit axis and having a plurality of blades extending therefrom; a plurality of cutters secured to the blades at different circumferential positions relative to the bit axis, each cutter defining a cutter sweep profile as the bit body rotates about the bit axis, wherein one or more of the cutters have overlapping cutter sweep profiles to define a kerf therebetween; and the plurality of cutters include a shaped cutter comprising a cutting face and a shaped portion on the cutting face aligned for engaging and removing the kerf.

Example 2. The fixed cutter drill bit of Example 1, wherein the shaped portion has a shape matching a shape of the kerf.

Example 3. The fixed cutter drill bit of Example 2, wherein the shape of the shaped portion that matches the shape of the kerf is at least slightly inwardly offset from the shape of the kerf to increase a contact stress where the shaped portion engages the kerf.

Example 4. The fixed cutter drill bit of any of Examples 1-3, wherein the shaped cutter defines a cutter axis passing through a substrate and a cutting table of the shaped cutter, and wherein the shaped portion comprises a plurality of shaped portions on the cutting table circumferentially spaced about the cutter axis, such that the shaped cutter is positionable about the cutter axis to align any of the shaped portions with the kerf.

Example 5. The fixed cutter drill bit of Example 4, wherein each shaped portion has substantially the same shape to match a shape of the kerf.

Example 6. The fixed cutter drill bit of Example 4-5, wherein each shaped portion of the shaped cutter has a different shape corresponding to different kerfs corresponding to different cutter locations on the bit body, such that the shaped cutter is positionable at any of the different cutter locations with the corresponding shaped portion aligned with the respective kerf at that cutter location.

Example 7. The fixed cutter drill bit of any of Examples 4-6, wherein the cutting face of the shaped cutter is not perpendicular to the cutter axis.

Example 8. The fixed cutter drill bit of any of Examples 4-7, wherein the shaped cutter further comprises a reinforcing bridge extending across a recessed portion of the cutting face to each of the shaped portions.

Example 9. The fixed cutter drill bit of Example 8, wherein the reinforcing bridge has a bridge height with respect to the recessed portion of the cutting face of less than a height of the shaped portions with respect to the cutting face.

Example 10. The fixed cutter drill bit of Example 9, wherein the bridge height is at least half of the height of each shaped portion.

Example 11. The fixed cutter drill bit of Example 8-9, wherein the bridge is tapered from the cutting face to the bridge height.

Example 12. The fixed cutter drill bit of Examples 8-10, wherein the shaped portions are each tapered from the cutting face to the height of the shaped portions.

Example 13. The fixed cutter drill bit of any of Examples 1-12 to wherein the kerf comprises a plurality of overlapping arcs corresponding respectively to the overlapping cutter sweep profiles.

Example 14. A method of forming a drill bit, the method comprising: securing a plurality of cutters at different positions on a bit body defining a bit axis; identifying overlapping cutter sweep profiles to be defined by rotating the bit body about the bit axis and a kerf defined between the overlapping cutter sweep profiles; forming a shaped cutter with a shaped portion on the cutting face having a shape conforming with a shape of the kerf; and securing the shaped cutter to the drill bit with the shaped portion of the shaped cutter aligned with the kerf.

Example 15. The method of Example 14, further comprising: identifying the overlapping cutter sweep profiles and the corresponding kerf and the shape of the raised portion based on target values of one or more bit dynamic parameters including one or both of a bit rotation rate and an axial drilling rate.

Example 16. The method of Example 14-15, further comprising: forming the shaped cutter with a plurality of shaped portions of the same size and shape, circumferentially spaced about a cutter axis.

Example 17. The method of any of Examples 14-16, further comprising: forming the shaped cutter with a plurality of shaped portions circumferentially spaced about a cutter axis, each sized corresponding to a different depth of cut.

Example 18. The method of any of Examples 14-17, further comprising: forming the shaped cutter with a plurality of shaped portions circumferentially spaced about a cutter axis, each shaped according to a different cutter location on the bit body.

Example 19. The method of any of Examples 14-18, wherein the steps of securing the plurality of cutters, identifying overlapping cutter sweep profiles, forming the shaped cutter with the shaped portion, and securing the shaped cutter to the drill bit with the shaped portion of the shaped cutter aligned with the kerf are first performed to form the drill bit as a computer model and subsequently performed to form the drill bit as a physical drill bit.

Example 20. A method of drilling a wellbore, comprising: rotating a drill bit about a bit axis with a plurality of cutters engaging the formation, each cutter defining a cutter sweep profile as it travels about the bit axis; forming a kerf in the formation between cutters having overlapping cutter sweep profiles; and subsequently removing the kerf with a shaped cutter having a shaped portion aligned with the kerf and a shape conforming to a shape of the kerf.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A fixed cutter drill bit, comprising:

a bit body defining a bit axis and having a plurality of blades extending therefrom;

a plurality of cutters secured to the blades at different circumferential and/or radial positions relative to the bit axis, each cutter defining a cutter sweep profile corresponding to a path of a respective cutting face of each cutter as the bit body rotates about the bit axis, wherein two or more cutters of the plurality of cutters have at least partially overlapping cutter sweep profiles; and wherein at least one cutter of the plurality of cutters includes a shaped cutter comprising a cutting face with a recessed portion and a shaped portion, wherein the shaped portion includes a raised portion configured to engage a portion of uncut formation disposed between respective cutter sweep profiles of radially adjacent cutters, and wherein the shape of the shaped portion is bounded by the overlapping cutter sweep profiles of the radially adjacent cutters and an outer edge of the cutting face.

2. The fixed cutter drill bit of claim 1, wherein the shaped portion spans from the overlapping cutter sweep profiles of the radially adjacent cutters to the outer edge of the cutting face.

3. The fixed cutter drill bit of claim 2, wherein the shape of the shaped portion bounded by the overlapping cutter sweep profiles of the radially adjacent cutters and an outer edge of the cutting face is inwardly offset from the overlapping cutter sweep profiles of the radially adjacent cutters and/or the outer edge of the cutting face.

4. The fixed cutter drill bit of claim 1, wherein the shaped cutter defines a cutter axis passing through a substrate and a cutting table of the shaped cutter, and wherein the shaped cutter comprises at least one additional shaped portions formed on the cutting table, wherein the shaped cutter and the at least one additional shaped cutter are circumferentially spaced about the cutter axis.

5. The fixed cutter drill bit of claim 4, wherein the at least one additional_shaped portion has the same shape as the shaped portion.

6. The fixed cutter drill bit of claim 4, wherein each shaped portion of the shaped cutter has a different shape corresponding to different portions of uncut formation corresponding to different cutter locations on the bit body, such that the shaped cutter is positionable at any of the different cutter locations with the corresponding shaped portion aligned with the respective portion of uncut formation at that cutter location.

7. The fixed cutter drill bit of claim 4, wherein the cutting face of the shaped cutter is not perpendicular to the cutter axis.

8. The fixed cutter drill bit of claim 4, wherein the shaped cutter further comprises a reinforcing bridge extending across a recessed portion of the cutting face to each of the shaped portions.

9. The fixed cutter drill bit of claim 8, wherein the reinforcing bridge has a bridge height with respect to the recessed portion of the cutting face of less than a height of the shaped portions with respect to the cutting face.

10. The fixed cutter drill bit of claim 9, wherein the bridge height is at least half of the height of each shaped portion.

11. The fixed cutter drill bit of claim 8, wherein the bridge is tapered from the cutting face to a bridge height of the reinforcing bridge.

12. The fixed cutter drill bit of claim 8, wherein the shaped portions are each tapered from the cutting face to a height of the shaped portions with respect to the cutting face.

13. A method of forming a drill bit, the method comprising:

securing a plurality of cutters at different positions on a bit body defining a bit axis;

identifying a cutter sweep profile for each cutter of the plurality of cutters, wherein each cutter sweep profile corresponds to a path of a respective cutting face of each cutter of the plurality of cutters;

identifying overlapping cutter sweep profiles to be defined by rotating the bit body about the bit axis, wherein two or more cutters of the plurality of cutter have at least partially overlapping cutter sweep profiles;

forming a shaped cutter comprising a cutting face with a recessed portion and a shaped portion, wherein the shaped portion includes a raised portion configured to engage a portion of uncut formation disposed between respective cutter sweep profiles of adjacent cutters, and wherein the shape of the shaped portion is bounded by the overlapping cutter sweep profiles of the adjacent cutters and an outer edge of the cutting face; and securing the shaped cutter to the drill bit with the shaped portion of the shaped cutter aligned with the portion of uncut formation disposed between respective cutter sweep profiles of adjacent cutters.

14. The method of claim 13, further comprising:

identifying the shape of the shaped portion bounded by the overlapping cutter sweep profiles of the adjacent cutters and the outer edge of the cutting face based on target values of one or more bit dynamic parameters including one or both of a bit rotation rate and an axial drilling rate.

15. The method of claim 13, further comprising:

forming the shaped cutter with a plurality of shaped portions of the same size and shape, circumferentially spaced about a cutter axis.

16. The method of claim 13, further comprising:

forming the shaped cutter with a plurality of shaped portions circumferentially spaced about a cutter axis, each sized corresponding to a different depth of cut.

17. The method of claim 13, further comprising:

forming the shaped cutter with a plurality of shaped portions circumferentially spaced about a cutter axis, wherein the plurality of shape portions includes a first shaped portion and a second shaped portion, and wherein the first shaped portion has a different size than the second shaped portion.

18. The method of claim 13, wherein the steps of securing the plurality of cutters, identifying the cutter sweep profile for each cutter of the plurality of cutters, identifying overlapping cutter sweep profiles, forming the shaped cutter, and securing the shaped cutter to the drill bit with the shaped portion of the shaped cutter aligned with the portion of uncut formation are first performed to form the drill bit as a computer model and subsequently performed to form the drill bit as a physical drill bit.

19. A method of drilling a wellbore, comprising:

rotating a drill bit about a bit axis with a plurality of cutters engaging the formation, each cutter defining a cutter sweep profile corresponding to a path of a respective cutting face of each cutter as the bit body rotates about the bit axis, wherein two or more cutters of the plurality of cutters have at least partially overlapping cutter sweep profiles, wherein at least one cutter of the plurality of cutters includes a shaped cutter comprising a cutting face with a recessed portion and a shaped portion, wherein the shaped portion includes a raised portion configured to engage a portion of uncut formation disposed between respective cutter sweep profiles of radially adjacent cutters, and wherein the shape of the shaped portion is bounded by the overlapping cutter sweep profiles of the radially adjacent cutters and an outer edge of the cutting face;

forming a portion of uncut formation disposed between respective cutter sweep profiles of radially adjacent cutters in response to rotation of the drill bit; and subsequently removing the portion of uncut formation with the shaped portion of the shaped cutter in response to further rotation of the drill bit, wherein the shaped portion is aligned with the portion of uncut formation.

* * * * *